US005969613A

United States Patent [19]

Yeager et al.

[11] Patent Number: 5,969,613

[45] Date of Patent: Oct. 19, 1999

[54] ELECTRONIC ARTICLE SURVEILLANCE SECURITY DEVICE

[75] Inventors: Lawrence R. Yeager, Uniontown; James T. Weisburn, Massillon, both of Ohio; David P. Ignaczak, Sarver, Pa.; James A. McGill; Robert L. Michael, both of Canton, Ohio

[73] Assignee: Alpha Enterprises, Inc., North Canton, Ohio

[21] Appl. No.: 09/007,598

[22] Filed: Jan. 15, 1998

Related U.S. Application Data

[63] Continuation-in-part of application No. 08/916,469, Aug. 11, 1997, abandoned.

[51] Int. Cl.[6] ..... G08B 13/14

[52] U.S. Cl. ..... 340/572.9; 340/572.1; 340/572.8; 340/571; 340/568.1

[58] Field of Search ..... 340/572.1, 572.8, 340/572.9, 571, 568.1, 573.4

[56] References Cited

U.S. PATENT DOCUMENTS

| | | | |
|---|---|---|---|
| 1,601,493 | 9/1926 | Condon | 340/572.1 |
| 3,214,808 | 11/1965 | Litwin | 24/16 |
| 3,636,739 | 1/1972 | Smedley | 70/58 |
| 3,754,420 | 8/1973 | Oellerich | 70/58 |
| 3,872,547 | 3/1975 | Caveney et al. | 24/16 PB |
| 4,071,023 | 1/1978 | Gregory | 128/133 |
| 4,128,220 | 12/1978 | McNeel | 248/60 |
| 4,191,334 | 3/1980 | Bulanda et al. | 24/16 PB |
| 4,196,424 | 4/1980 | Williamson | 340/572 |
| 4,287,644 | 9/1981 | Durand | 24/16 PB |
| 4,299,870 | 11/1981 | Humble | 428/101 |
| 4,499,680 | 2/1985 | Cobura | 40/304 |
| 4,506,415 | 3/1985 | Swift | 24/16 PB |
| 4,580,319 | 4/1986 | Paradis | 24/16 PB |
| 4,631,782 | 12/1986 | Gecs | 24/16 PB |
| 4,708,306 | 11/1987 | Mitomi | 248/74.3 |
| 4,813,105 | 3/1989 | Espinoza | 24/16 RB |
| 4,823,442 | 4/1989 | Behr | 24/20 R |
| 4,825,156 | 4/1989 | Read | 324/166 |
| 4,833,807 | 5/1989 | McLean | 40/633 |
| 4,897,899 | 2/1990 | Shely et al. | 24/16 PB |
| 4,919,373 | 4/1990 | Caveney et al. | 248/74.3 |
| 4,944,475 | 7/1990 | Ono et al. | 248/71 |
| 4,958,414 | 9/1990 | Benoit | 24/16 PB |
| 4,962,369 | 10/1990 | Close | 340/572 |
| 5,042,114 | 8/1991 | Parrish | 24/16 PB |
| 5,079,540 | 1/1992 | Narlow et al. | 340/572 |
| 5,119,652 | 6/1992 | Costa | 70/57.1 |
| 5,121,524 | 6/1992 | Mortensen | 24/16 PB |
| 5,123,686 | 6/1992 | Wenk | 292/321 |
| 5,144,820 | 9/1992 | Holmgren | 70/57.1 |
| 5,230,541 | 7/1993 | Nowak | 292/288 |
| 5,279,136 | 1/1994 | Perry | 70/18 |
| 5,337,503 | 8/1994 | Goby | 40/665 |
| 5,377,388 | 1/1995 | DeBever | 24/16 PB |
| 5,437,172 | 8/1995 | Lamy et al. | 70/57.1 |
| 5,440,904 | 8/1995 | Su | 70/18 |
| 5,517,835 | 5/1996 | Smith | 70/14 |
| 5,524,463 | 6/1996 | Schenkel et al. | 70/57.1 |
| 5,568,951 | 10/1996 | Morgan | 292/307 A |
| 5,627,520 | 5/1997 | Grubbs et al. | 340/572 |

*Primary Examiner*—Daniel J. Wu
*Assistant Examiner*—Toan N. Pham
*Attorney, Agent, or Firm*—Sand & Sebolt

[57] ABSTRACT

An electronic article surveillance security device securable to an article to be protected from theft where the device includes a strap that is wrapped around or inserted through the article, and then tightly secured within a housing of the device that includes an electronic article surveillance tag. The housing has smooth tamper resistant seams and edges and a locking device for securely holding the strap once inserted therein. The strap includes ribs that are engageable within the housing by locking fingers and lips, all of which define a one-way locking mechanism that allows for insertion of the strap but denies removal once inserted. In at least one embodiment of the invention, a locking mechanism is provided that may be unlocked such that the security device may be reused with various articles.

13 Claims, 13 Drawing Sheets

12345 67890
19
20
600
601
602
603
604
606
620
621
630
640
641
642
643
644
645
650
651
665
675
679
680
681
682
690
691
702
704

FIG-20
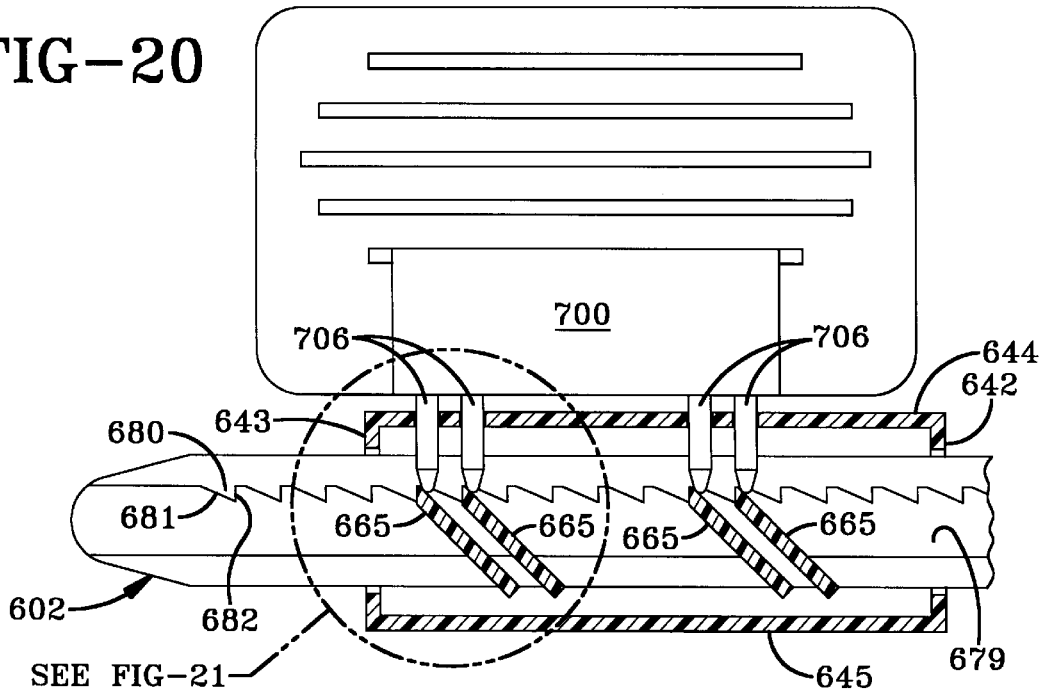
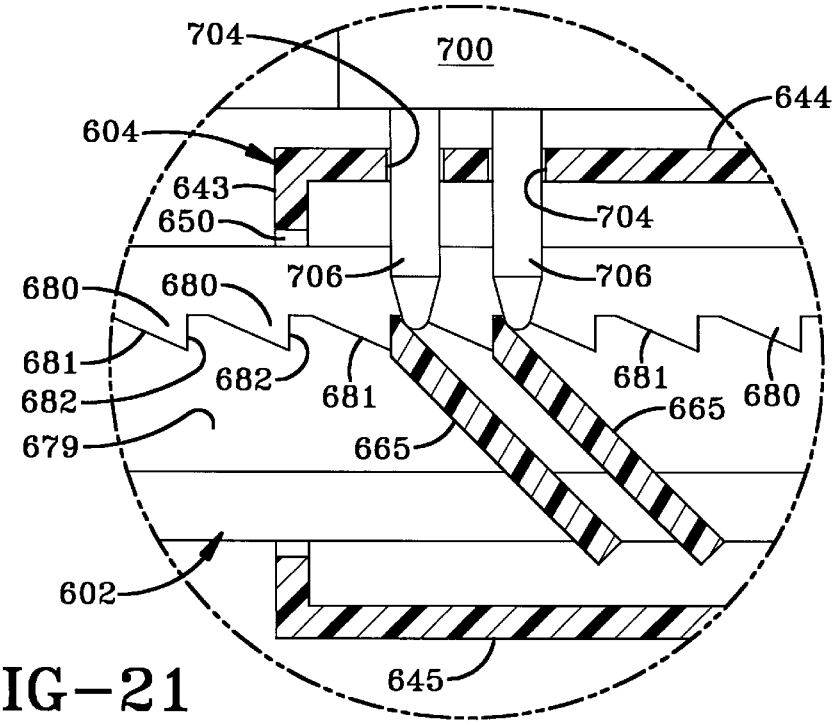
FIG-21

ELECTRONIC ARTICLE SURVEILLANCE SECURITY DEVICE

CROSS REFERENCE TO RELATED APPLICATIONS

This application is a continuation-in-part of U.S. patent application Ser. No. 08/916,469, filed on Aug. 11, 1997, which is abandoned.

BACKGROUND OF THE INVENTION

1. Technical Field

The invention relates to article security devices as used by retail and similar stores and outlets. More particularly, the invention relates to electronic article surveillance security devices attachable to articles in a manner substantially impossible to remove or disable absent cutting or other destruction of the device or using a key that releases the devices. Specifically, the invention is an electronic article surveillance security device tightly securable to or around the article to be protected by wrapping a strap therearound or therethrough followed by securing the strap within a housing that includes an electronic article surveillance tag where the housing has smooth tamper resistant seams and edges and a locking device for securely holding the strap once inserted.

2. Background Information

In recent years, the occurrences of shoplifting and other forms of theft of articles of all types has grown significantly. For various reasons including trends or fads, as well as the desire to be or look like sports and entertainment heros, the desire to own by any means certain articles including electronic devices and recorded media, sporting goods, and clothing has become ever more popular and desirable. This is obvious from today's trends of assault and even murder over various trendy forms of clothing, shoes, or athletic equipment. Accordingly, shoplifting and theft have become even more prevalent in the areas of electronic devices and recorded media, sporting goods, and clothing. This is particularly true on high priced articles, many of which are high priced to pay for a name or endorsement.

Correspondingly, the need to prevent, deter, stop and/or catch these thieves has become of utmost importance to every retail store owner. For this reason, various forms of electronic article surveillance have been developed. These new forms are particularly prevalent in the electronic devices and recorded media area where numerous security devices, typically article specific, have been developed. For instance, in the recorded media area numerous article specific security devices such as compact disc/jewel case security devices have been developed that include means of electronic article surveillance while supplying a secure device that further allows for standard display of the article.

In the sporting goods area for instance, the articles are often not of standard shapes and sizes. For example, baseball mitts are available in many different sizes and shapes. For this reason, a standardized security device is not desirable. In addition, many retail store owners would prefer a security device that is usable not only on different models of a given article, but also on different types of articles of varying sizes, shapes, etc., that is on baseball mitts, roller blades, and ski poles for instance.

Often, various prior art electronic article surveillance tags are placed on the article in an attempt to protect the article from theft. Usually some attempt is made to hide the tag within the article, although many articles do not contain sufficient hiding places. Where sufficient hiding places exist, the process of hiding and/or later removing the tag is often cumbersome. In general, these tags have had some success curbing theft.

However, at least some shoplifters and thieves have recognized that these tags are often easy to remove, sometimes as simply as peeling them off, and/or to circumvent often by merely squeezing the tag while exiting through the store detector. For this reason a need exists for a more universal security device usable with different types, sizes and shapes of articles where the device is not readily removed or disabled and is preferably protected yet still allows the article to be displayed in a standard manner which allows for examination and/or use by the prospective purchaser.

SUMMARY OF THE INVENTION

Objectives of the invention include providing an improved security device for use with articles offered for sale in standard retail venues.

Another objective of the invention includes providing an improved security device which can be mass produced relatively inexpensively as a one-piece molded plastic member.

Another objective of the invention includes providing an improved security device capable of being secured to various types of articles of various shapes and sizes.

Another objective of the invention includes providing an improved security device that is inexpensive and easy to both make and use, and which can be manually loaded by retail shop personnel for subsequent sale.

Another objective of the invention includes providing an improved security device which can be molded of rugged plastic material that is very difficult to break, rip, or otherwise disable without the use of scissors or other large tools.

Another objective of the invention includes providing an improved security device having a pair of compartments connected by a living hinge where a portion of at least one of the compartment includes a void for the placement and storage of an electronic article surveillance tag therein, preferably in an inconspicuous manner, but in any case, to detect unauthorized removal of the security package with an article therein from the retail business.

Another objective of the invention includes providing an improved security device having a pair of compartments connected by a living hinge whereby the compartments when mated form a chamber for housing an electronic article surveillance tag and securing a strap wrapped around the article and affixed to one of the compartments.

Another objective of the invention includes providing an improved security device having a pair of compartment connected by a living hinge whereby the compartments when mated form a smooth housing without edges, lips, grooves, or other pry points thereby making disablement and/or destruction of the housing difficult.

Another objective of the invention includes providing an improved security device having locking levers and projections for snap fitting a pair of compartments together thereby permanently connecting the compartment together so as to form a chamber therebetween for housing an electronic article surveillance tag and securing a strap wrapped around the article and affixed to one of the compartments.

Another objective of the invention includes providing an improved security device having a strap extending from a housing where the strap is for wrapping around an article to be protected, the strap after wrapping being insertable within the housing and permanently affixed therein.

Another objective of the invention is to provide such an improved security package that includes a strap wrappable around the article to be protected and permanently securable within the housing whereby the strap includes a plurality of ribs on its top and bottom surfaces for prohibiting removal of the strap once inserted within the housing.

Another objective of the invention is to provide such an improved security package that includes a locking mechanism within the housing where the locking mechanism prohibits removal of the strap once inserted within the housing.

Another objective of the invention includes providing an improved security device made of a rugged yet flexible plastic that is very difficult to tear, break, rip, or otherwise sever without cutting tools.

Another objective of the invention is to provide such an improved security device which can be easily injection molded of various types of plastics in one component with a pair of sides separated by a living hinge, and with a strap extending from one of the sides, thus providing for the economic manufacture and assembly of the security container.

Another objective of the invention is to provide such an improved security package which includes a locking mechanism within the housing where the locking mechanism prohibits removal of the strap once inserted within the housing until the locking mechanism is released with a key to allow the strap to be removed from the housing and the security device reused.

Another objective of the invention is to provide such an improved security package that includes a releasable locking mechanism within the housing that provides substantially the same protection as security packages having nonreleasable locking mechanisms.

Another objective of the invention is to provide such an improved security package which is of an extremely simple construction, which achieves the stated objectives in a simple, effective, and inexpensive manner, and which solves problems and satisfies needs in the art.

These and other objectives and advantages are obtained by the improved security package of the invention, the general nature of which may be stated as including a security package affixable around or interwoven through an article to be protected from theft comprising:

- a housing defining a lock compartment having an entry port and an exit port with a locking mechanism therebetween; and
- a strap having a proximate end, a distal end, and an intermediate section therebetween having a serrated surface thereon for selective interaction with the locking mechanism, the proximate end being affixed to the housing and the distal end being selectively insertable within the lock compartment.

BRIEF DESCRIPTION OF THE DRAWINGS

Preferred embodiments of the invention, illustrative of the best mode in which applicants have contemplated applying the principles, are set forth in the following description and are shown in the drawings and are particularly and distinctly pointed out and set forth in the appended claims.

FIG. 20 is a sectional rear view of the security device with the strap in a locked position and the key in a first position;

FIG. 21 is an enlarged sectional view depicting the engagement of the key tangs with the locking fingers;

Similar numerals refer to similar parts throughout the drawings.

DESCRIPTION OF THE PREFERRED EMBODIMENTS

Figure 1:
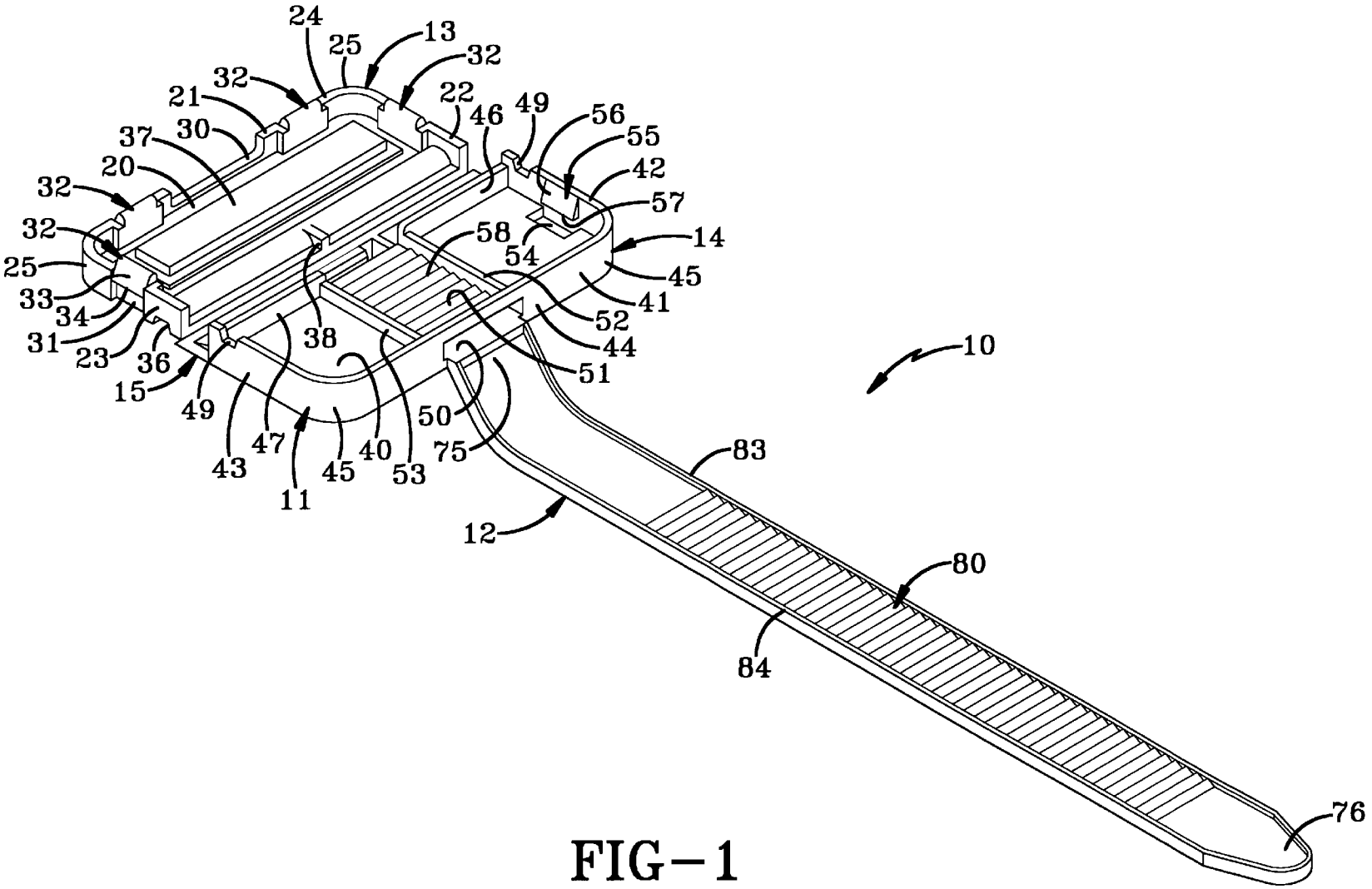
FIG. 1 is a perspective view of a first embodiment of the security device of the present invention with the housing in an open position and the strap extending freely therefrom.

One embodiment of the improved security device of the present invention is indicated generally at 10, and is shown particularly in FIG. 1. The security device 10 is formed as an integral one-piece plastic member, most preferably of a high-impact and rugged polymer having some flexibility characteristics. The security device 10 includes a main housing 11 with an elongated strap 12 extending therefrom. Main housing 11 includes a lid 13, a base 14, and a hinge assembly 15 therebetween as shown in FIG. 1.

Lid 13 includes a planar base 20 of a generally rectangular configuration having inner and outer surfaces. A continuous wall 21 extends substantially perpendicularly outward from the periphery of base 20 along the inner surface. Wall 21 includes a pair of side portions 22 and 23 separated by an end portion 24 where a smooth curved corner 25 connects end 24 to each of sides 22 and 23.

End 24 includes an elongated cut-out 30 approximately centered therein. In the outer face of wall 21 are a plurality of recesses 31 indented in the outer face of wall 21 and extending inward into the inner face of wall 21. Each recess 31 includes a locking mechanism 32 therein, each with a tapered entry surface 33 terminating in a locking lip 34. In the embodiment shown in FIG. 1, a locking mechanism is positioned in each of sides 22 and 23, while two are also positioned in end 24 separated by cut-out 30.

A groove 36 extends into the outer surface of wall 20 in a parallel, spaced apart and adjacent manner to hinge assembly 15. Groove 36 is rounded or semi-cylindrical in nature and defines a cut line along which the device may be more readily cut to open or otherwise disable and remove the device from the article. The extension of groove 36 into the outer surface of wall 20 defines a rounded projection in the inner surface of wall 20. At the center of this rounded projection is a finger stop 38 extending outward therefrom which prevents a locking finger 65 from being flexed back upon itself and provides support for the finger.

An electronic article surveillance (EAS) tag 37 is affixed to or positioned adjacent to the inner surface of wall 20 between this rounded projection associated with groove 36 and end 24. This EAS tag 37 is any electronic means capable of functioning in any manner as needed to assist in preventing article theft by indicating improper removal of the article from its present situs. This EAS tag 37 may be of any size so long as it fits herein.

Figure 2:
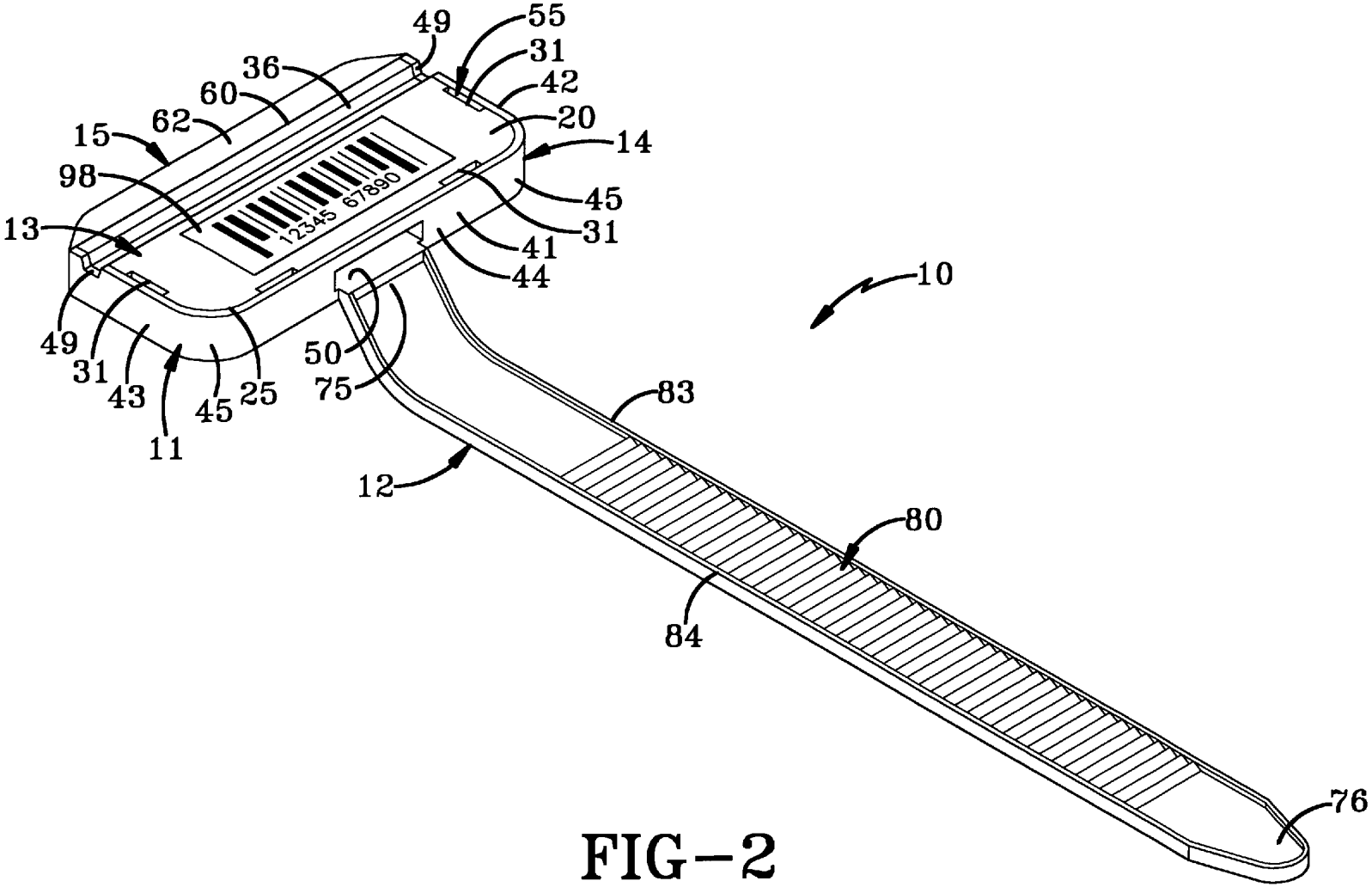
FIG. 2 is a perspective view of the security device of FIG. 1 with the housing in a closed position and the strap still freely extending therefrom.

Security device 10 may alternatively or additionally include a UPC (universal product code) or bar code tag 98 adhered to the exterior of the device, such as on lid 13 as shown in FIG. 2. If the tag 98 is a UPC, this tag may be used for inventory and pricing purposes as is well known in the art.

Base 14 includes a planar base 40 of a generally rectangular configuration having inner and outer surfaces. A continuous wall 41 extends substantially perpendicularly outward from the periphery of planar base 40 along the inner surface. Wall 41 includes a pair of side portions 42 and 43 separated by an end portion 44 where a smooth curved corner 45 connects end 44 to each of sides 42 and 43.

End 44 includes an elongated strap entrance slot 50 approximately centered therein. Short walls 46 and 47 extend adjacent hinge assembly 15 between sides 42 and 43 in the same direction outward from the planar base 40 as wall 41, and in a spaced apart manner from end 44. Short walls 46 and 47 are of a lesser height than wall 41 and have a gap 48 therebetween that correspondingly aligns with a slot 50. A channel 51 extends between gap 48 and slot 50 connecting the walls adjacent thereto, the channel 51 defined by a pair of opposed and parallel guides 52 and 53 of a shorter height than walls 46 and 47 and wall 41. The channel 51 may be smooth or in certain embodiments include serrations 58 for added holding power.

Wall 41 includes a pair of notches 49 and a plurality of nubs 55. Base 14 further includes a plurality of holes 54 in planar base 40 aligned with each of the nubs 55.

Each side 42 and 43 includes one of these notches 49. These notches are opposed to each other across planar base 40 and are adjacent hinge assembly 15. These notches align with groove 36 thereby further defining the cut line.

The plurality of nubs 55 extend inward from the inner face of wall 41. Each locking nub 55 has a tapered entry surface 56 terminating in a locking lip 57 where the tapered entry surface 56 tapers out from wall 41 as the surface extends toward planar base 40.

Figure 4:
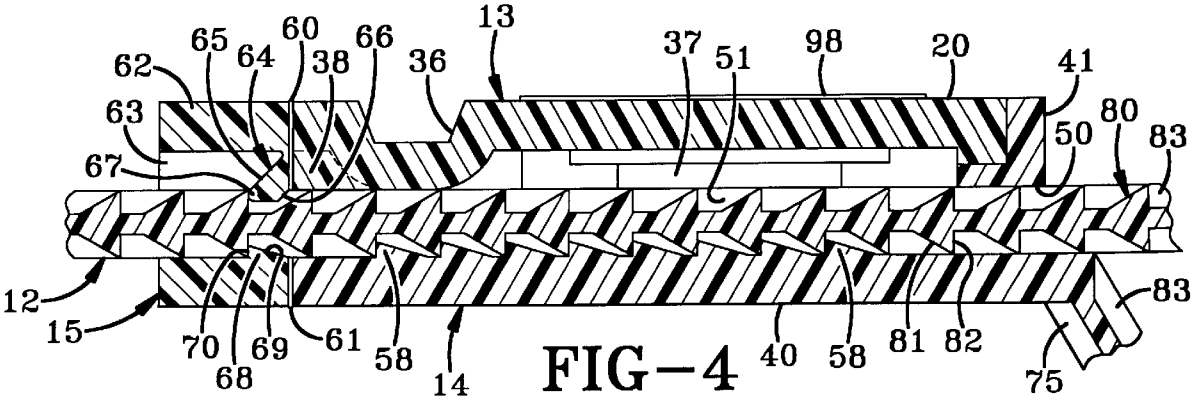
FIG. 4 is an enlarged sectional view of the security device of FIGS. 1–3 taken along line 4—4 in FIG. 3.

Hinge assembly 15 as is shown in FIGS. 1 and 4, hingedly connects lid 13 to base 14. Hinge assembly 15 includes a pair of living hinges 60 and 61 separated by a rigid hinge body 62, where living hinge 60 hingedly connects lid 13 to body 62 and living hinge 61 hingedly connects base 14 to body 62. Hinge body 62 includes an elongated strap exit slot 63 that correspondingly aligns with gap 48 when the living hinges are closed.

As shown in FIG. 4, exit slot 63 includes a one-way locking mechanism 64 therein with a locking finger 65 having an angled entrance surface 66 and a transverse locking surface 67, and a locking ridge 68 also having an angled entrance surface 69 and a transverse locking surface 70. Locking finger 65 extends from body 62 near living hinge 60 while locking ridge 68 extends from body 62 near living hinge 61. Locking finger 65 and locking ridge 68 are thus at opposed ends of body 63 but are alignable across from one another within slot 63 when the hinges 60 and 61 are closed as is shown in FIG. 4.

Elongated strap 12 has a first or connected end 75 flexibly connected to base 14 and a second or free end 76 spaced apart therefrom. The free end 76 is preferably rounded, curved or otherwise smoothed for easier insertion of the strap 12 within a slot, such as slot 50.

Elongated strap 12 has two major surfaces, a top and a bottom. Both major surfaces include a plurality of transverse ribs 80 extending over a substantial portion thereof. Each rib 80 has an angled entrance surface 81 and a transverse locking surface 82. Each rib 80 extends transversely across the top or bottom surface from an outer edge 83 to an outer edge 84.

Figure 5:
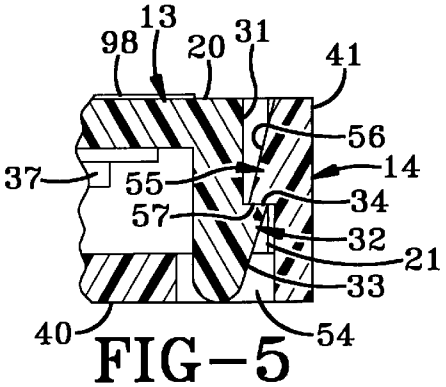
FIG. 5 is an enlarged sectional view of the security device of FIGS. 1–3 taken along line 5—5 in FIG. 3.

In operation, once an EAS tag 37 has been permanently affixed to planar base 20 or alternatively fitted within the area between wall 21 and the rounded projection caused by groove 36 or any other desired location, lid 13 may be permanently closed within base 14. Hinge assembly 15 allows this closing, specifically, living hinges 60 and 61 hingedly bend such that lid 13 moves from a planar position with base 14 as shown in FIG. 1 to a seated position within base 14 as shown in FIGS. 2 and 5. This seated position is made possible because lid 13 is slightly smaller than base 14 such that wall 21 just fits within wall 41 as shown in FIG. 2.

When lid 13 is fully seated within base 14, the plurality of lock nubs 55 are each locked in a corresponding locking mechanism 32. In use, as lid 13 enters base 14, tapered entry surface 56 of each lock nub 55 on base 14 engages and slides over tapered entry surface 33 of each locking mechanism 33 of lid 13. Once tapered entry surface 56 has slid over tapered entry surface 33, locking lip 57 engages locking lip 34 thereby securing lid 13 in base 14. This locked or secured position is shown in FIG. 5.

Figure 3:
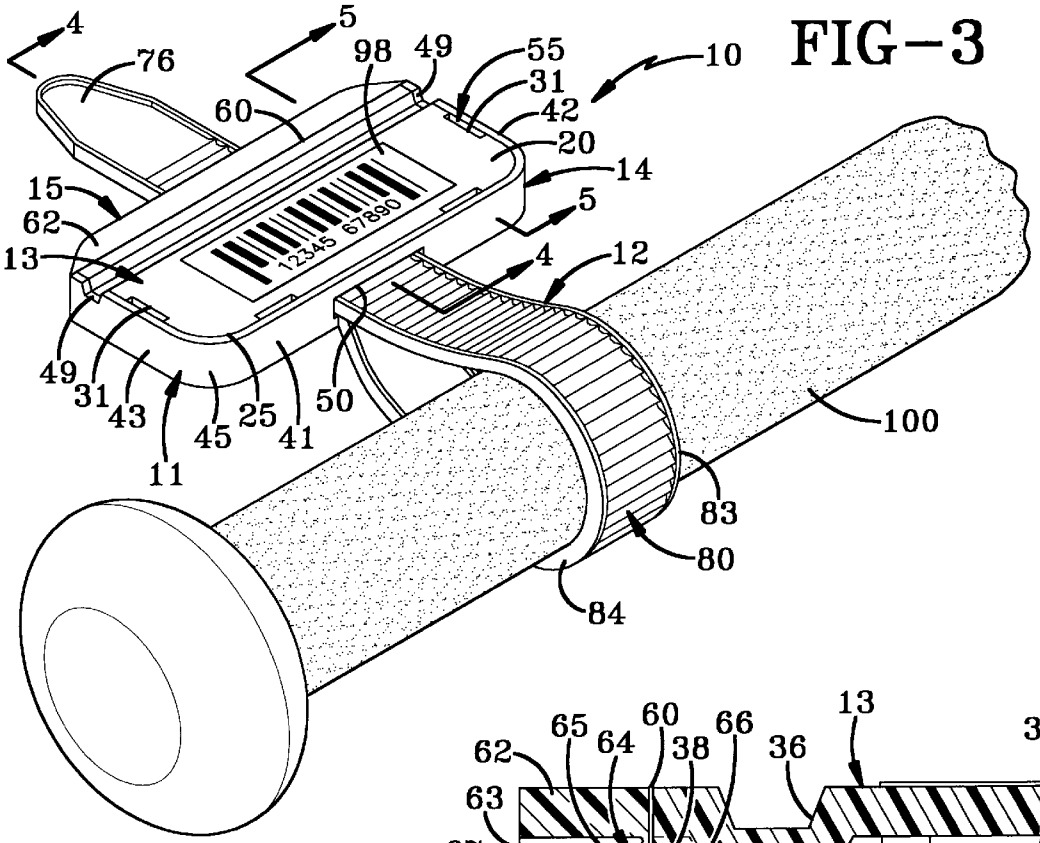
FIG. 3 is a perspective view of the security device of FIGS. 1–2 with the housing in a closed position and the strap wrapped around an article, in this case a baseball bat, to be protected from theft, where the strap is locked within the housing.

The security device 10 is now ready for securing to an article 100. The article 100 could be any item in any retail store deemed valuable enough to protect via a security system. One example of such an item is a baseball bat as is fragmentarily shown in FIG. 3. As shown in FIG. 3, the strap 12 of the security device 10 has been wrapped around the article 100 and inserted within slot 50 but not yet snugged. Strap 12 must be either pulled or pushed further within slot 50 and channel 51, and through or out slot 63 until the strap tightly engages the article to be protected from theft.

The insertion of strap 12 within slot 50, along channel 51, and eventually through slot 63 secures the strap therein. This securing is a result of the one-way locking features of the present invention as is shown in FIG. 4 in detail. The one-way locking feature is defined by the ribs 80 on the strap 12 and the one-way locking mechanism 64 in the hinge assembly 15. Specifically, each transverse rib 80 has angled entrance surface 81 and transverse locking surface 82, and the one-way locking mechanism 64 has locking finger 65 and locking ridge 68 where finger 65 has angled entrance surface 66 and transverse locking surface 67, and ridge 68 has angled entrance surface 69 and transverse locking surface 70.

During insertion of strap 12 within security device 10, strap 12 smoothly slides within slot 50 and channel 51 (unless channel 51 is serrated whereby the serrations assist in the one-way locking). The rounded projection and strap guide 38 thereon, guide strap 12 toward slot 63 as strap 12 extends through channel 51. When strap 12 slides into hinge 15 at slot 63, angled entrance surface 81 on each rib 80 entering slot 63 rides over either angled entrance surface 66 or 69 and tightly fits therebetween due to the slight compression of the rib and slight bend in the finger 64. After each rib rides over the entrance surfaces, the finger 64 elastically returns thereby blocking removal of that rib as transverse locking surfaces 67 and 70 in the one-way locking mechanism engage transverse locking surface 82 on that rib.

As each additional rib is moved through this one-way locking feature, the strap 12 tightens around an article until eventually it is snug and the strap can no longer be tightened. The strap 12 is not removable due to the above described engagement of transverse locking surfaces 67 and 70 with locking surface 82. In this manner the security device 10 is affixable to any article 100 around or through which the strap 12 may be extended or inserted.

Security device 10 also provides protection against squeezing of the EAS tag 37 by completely storing EAS tag 37 within the device. In addition, internal walls 46–47 and 52–53 prevent squeezing of lid 13 against base 14.

Figure 7:
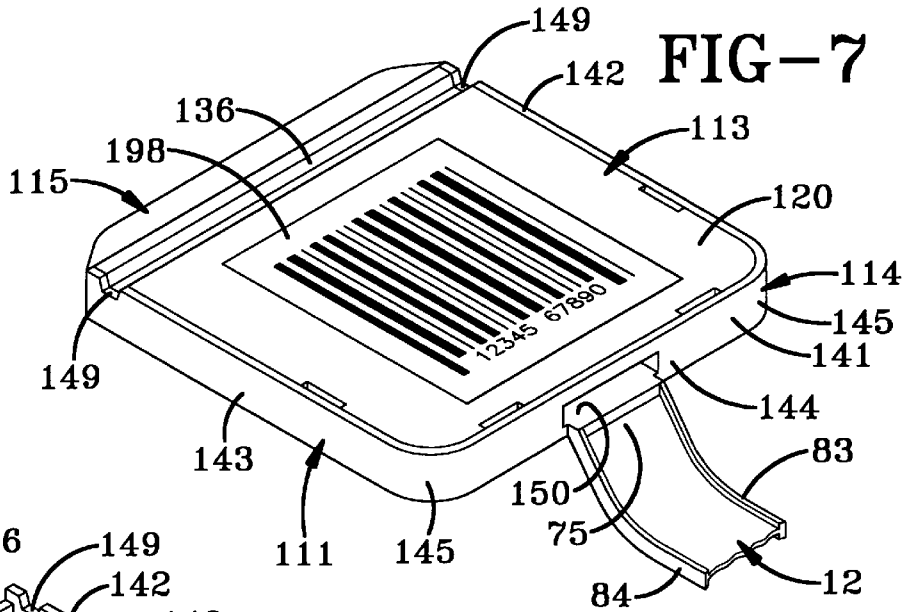
FIG. 7 is a fragmentary perspective view of the security device of FIG. 6 with the housing in a closed position and the strap freely extending therefrom.
Figure 6:
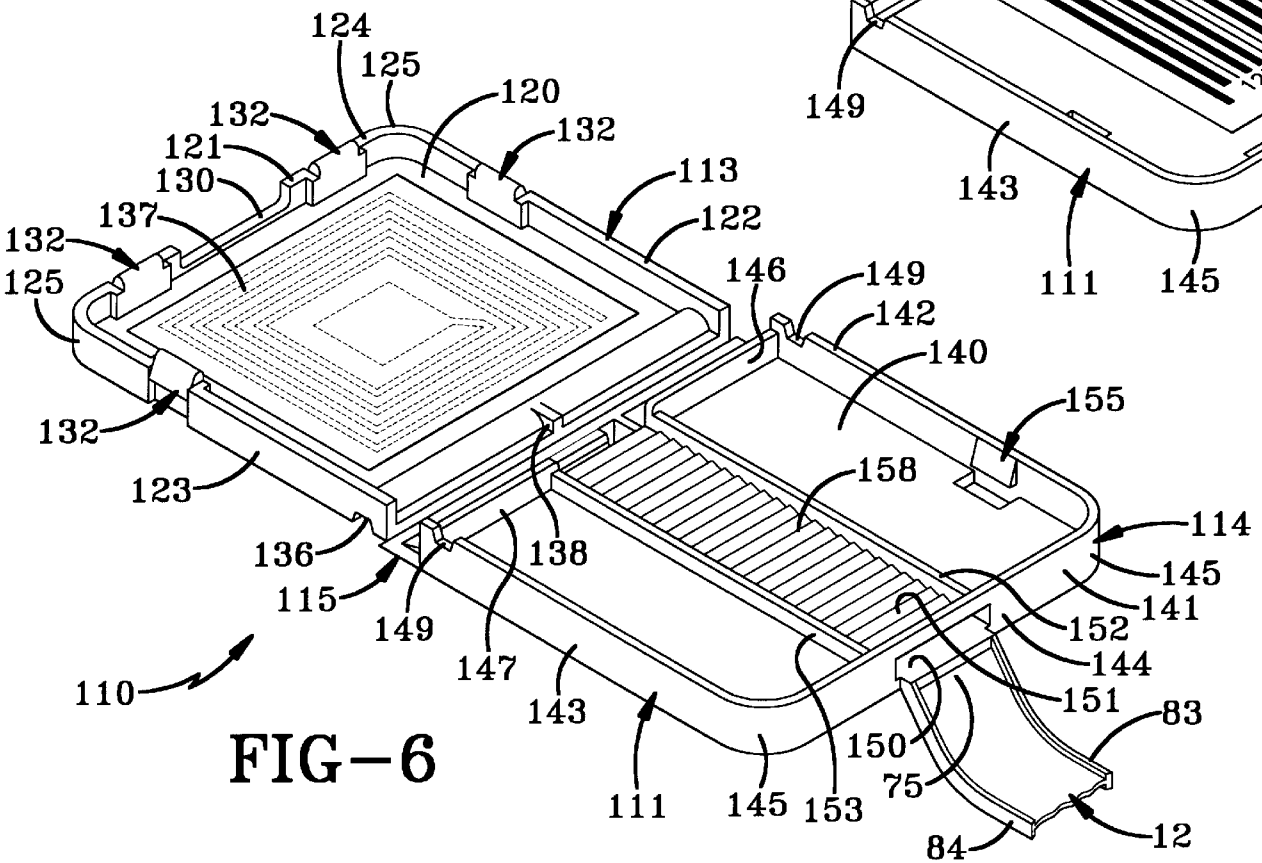
FIG. 6 is a fragmentary perspective view of a second embodiment of the security device of the present invention with the housing in an open position and the strap freely extending therefrom.

Another embodiment of the security device is shown in FIGS. 6 and 7, and indicated as security device 110. Security device 110 is similar to security device 10 except that rather than having rectangular bases 20 and 40, security device 110 has square or substantially square bases 120 and 140. The EAS tag 137 may also be a larger version. Alternatively or additionally, as similarly described above, an exterior EAS or UPC/bar code tag 198 may also be used herewith. Otherwise, device 110 is substantially identical in elements and use as device 10; however, many of the elements are of slightly different dimensions, sizes or shapes and thus are numbered in intervals of one-hundred from the similar element in the first embodiment.

Figure 8:
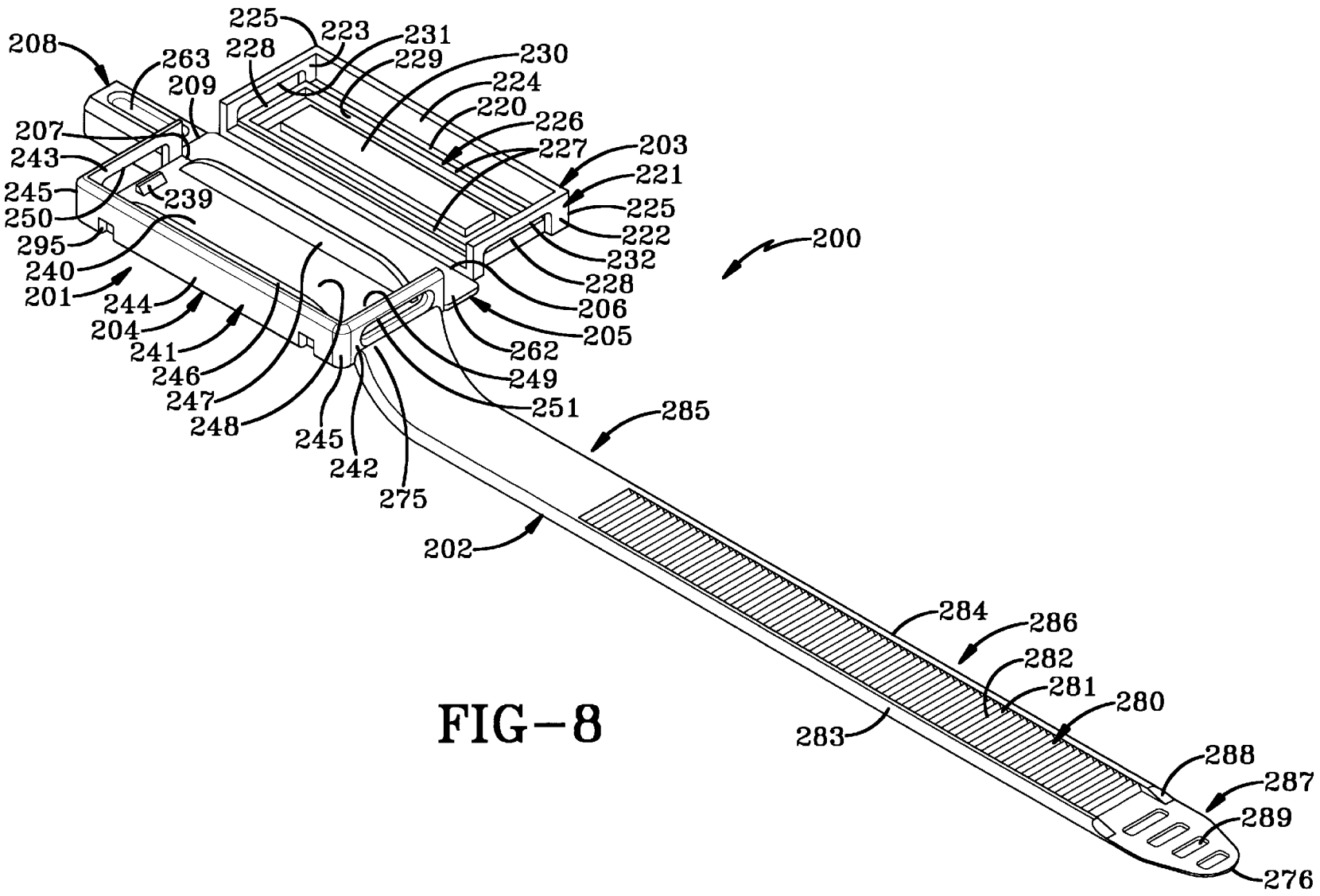
FIG. 8 is a perspective view of a third embodiment of the security device of the present invention with the housing in an open position and the strap extending freely therefrom.

A third embodiment of the improved security device of the present invention is indicated generally at 200, and is shown particularly in FIG. 8. The security device 200 is formed as an integral one-piece plastic member, most preferably of a high-impact and rugged polymer having some flexibility characteristics. The security device 200 includes a main housing 201 with an elongated strap 202 extending therefrom. Main housing 201 includes a lid 203, a base 204, a hinge assembly 205 therebetween with living hinges 206 and 207 flexibly and hingably connecting hinge assembly 205 to lid 203 and base 204, and an end assembly 208 flexibly and hingedly connected to hinge assembly 205 by a flexible living hinge 209 as shown in FIG. 8.

Lid 203 includes a planar base 220 of a generally rectangular configuration having inner and outer surfaces. A continuous wall 221 extends substantially perpendicularly outward from the periphery of base 220 along the inner surface. Wall 221 includes a pair of side portions 222 and 223 separated by an end portion 224 where a sharp corner 225 connects end 224 to each of sides 222 and 223.

Planar base 220 includes a raised wall 226 that extends outward from the inner surface of base 220 inward from the periphery thereof. Specifically, raised wall 226 is of a generally rectangular configuration and includes a pair of parallel elongated sides 227 spaced apart from one another and connected by a pair of parallel spaced-apart ends 228, all of which define an internal cavity 229 in which an EAS tag 230 is stored.

Lid 203 further includes a pair of cutouts 231 and 232 extending through opposing sides 222 and 223 through which strap 202 is insertable as described in more detail later. Each of cutouts 231 and 232 include rounded corners. Each of the cutouts is substantially elongated in its respective side 222 and 223. Each of the cutouts 231 and 232 has three sides, namely, an elongated side generally adjacent to the outermost peripheral edge of sides 222 and 223 (that is, furthest from planar base 220) and a pair of opposed, spaced apart, parallel ends that are perpendicular to the elongated side and extend therefrom to planar base 220. In effect, each cutout 231 and 232 has a fourth side as defined by ends 228 of raised wall 226.

The electronic article surveillance (EAS) tag 230 is affixed to the inner surface of planar base 220 within raised wall 226 as is shown in FIG. 8. Specifically, raised wall 226 extends outward from planar base 220 in a sufficient manner to completely protect EAS tag 230 from its sides. Specifically, raised wall 226 has a height greater than the standard height of any EAS tag 230 to be used. This protects the EAS tag 230 from strap 202 as it is inserted through cutouts 231 and 232 as described below in more detail. As indicated above, EAS tag 230 is any electronic means capable of functioning in any manner as needed to assist in preventing article theft by indicating improper removal of the article from its present situs.

Base 204 includes a planar base 240 of a generally rectangular configuration having inner and outer surfaces. A continuous wall 241 extends substantially perpendicularly outward from the periphery of planar base 240 along the inner surface. Wall 241 includes a pair of side portions 242 and 243 separated by an end portion 244 where a smooth curved corner 245 connects each end 244 to each of sides 242 and 243.

A pair of substantially parallel, spaced apart walls 246 and 247 extend outward from the inner surface of planar base 240. Specifically, each of walls 246 and 247 extend lengthwise from side 242 to side 243 thereby defining a channel 248 from side 242 to side 243. Each of walls 246 and 247 extends outward from planar base 240 less than the height of continuous wall 241, an amount equivalent to that necessary to allow lid 203 to seat within the cavity 249 as defined by continuous wall 241 and specifically, sides 242 and 243 and end 244, such that the outer surface of planar base 220 is flush with the outermost surface of continuous wall 241 about its periphery so as to define a smooth plane across the outer surface of planar base 220 as it extends outward therebeyond to the continuous wall 241 when lid 203 is seated within base 204. Walls 246 and 247 further may include a sloped end, as shown in FIG. 8, at each end thereof.

Figure 10:
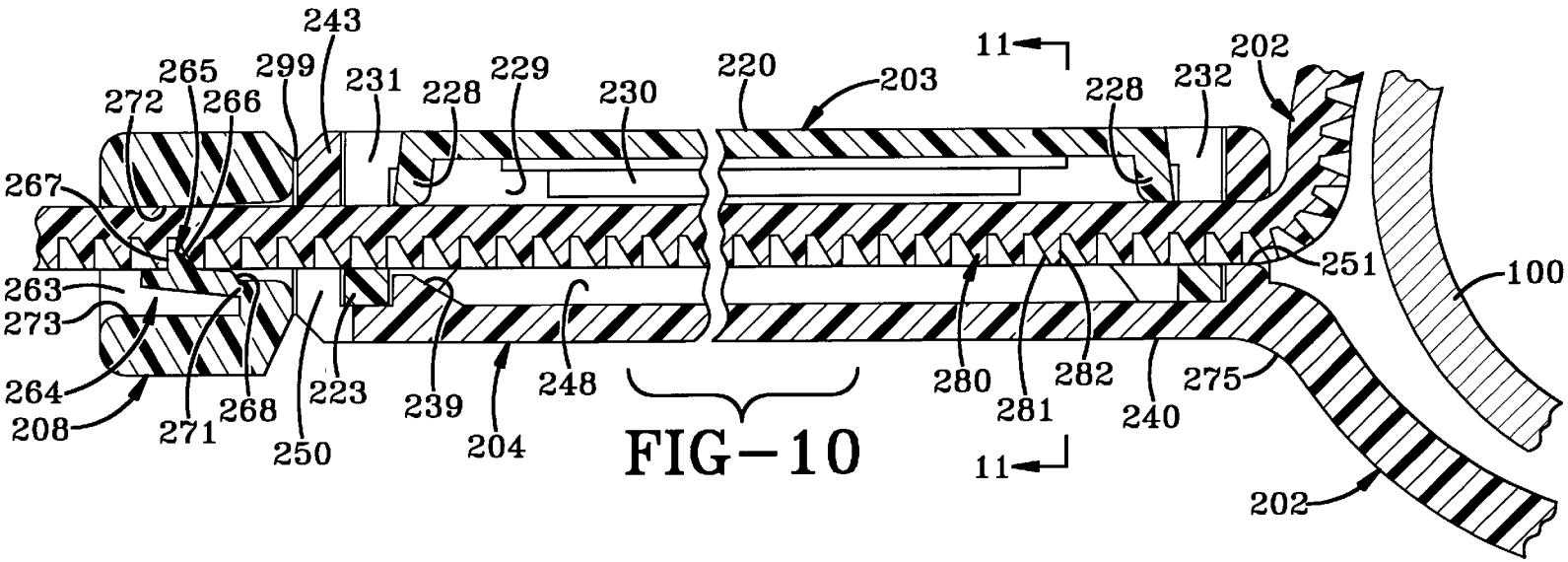
FIG. 10 is an enlarged sectional view of the security device of FIGS. 8–9 with a portion of the strap and article broken away.

At each end of the channel 248 as defined by walls 246 and 247 is a cutout, namely, a cutout 250 in side 243, and a cutout 251 in side 242. Cutout 250 is of a substantially identical construction to cutouts 231 and 232, namely, having three sides therein as cut completely through the wall and a fourth side as defined by planar base 240. Cutout 251 is an elongated oval-shaped cutout as is shown in FIG. 8 with two elongated, parallel, spaced-apart sides connected by two opposed, semi-circular ends. A ramp 239 (FIG. 8) is provided adjacent cutout 250 and is used to both prevent prying open of the lid 203 from the base 204, and to assist in holding strap 202 within housing 201 as best shown in FIG. 10.

Strap 202 flexibly extends outward from base 204 from a position adjacent to cutout 251 as is shown in FIG. 8. Strap 202 specifically includes two major surfaces, namely, a top and a bottom. Strap 202 has a first or connected end 275 flexibly connected to base 204 and a second of free end 276 spaced apart therefrom. The free end 276 is preferably rounded, curved or otherwise smooth for easier insertion of the strap 202 within cutout or slot 251. At least one of the major surfaces, namely, top or bottom surface, includes a plurality of transverse ribs 280 extending over a substantial portion thereof. Each rib 280 has an angled entrance surface 281 and a transverse locking surface 282. Each rib 280 extends transversely across the top or bottom surface from an outer edge 283 to an outer edge 284. In addition, the strap is generally in the preferred embodiment divided into a smooth portion 285, a ribbed portion 286 which includes the transverse ribs 280, and an insertion portion 287. A transition 288 exists between the ribbed portion 286 and the insertion portion 287 whereby the transition is typically a ramp surface. The insertion portion 287 may further include a plurality of slots 289 as is shown in FIG. 8.

Hinge assembly 205 hingedly connects lid 203 to base 204. Hinge assembly 205 includes a pair of living hinges 206 and 207 separated by a rigid hinge body 262 where living hinge 206 hingedly connects lid 203 to body 262 and living hinge 207 hingedly connects base 204 to body 262. Hinge body 262 includes an end assembly 208 hingedly connected by a living hinge 209 about one of the end surfaces of hinge body 262 that substantially parallely extend between living hinges 206 and 207 about one of the outermost edges of hinge assembly 205 as is shown in FIG. 8.

End assembly 208 includes a slot 263 extending therethrough and having a one-way locking mechanism 264 therein with a locking finger 265 having an angled entrance surface 266 and a transverse locking surface 267. Locking finger 265 extends from one-way locking mechanism 264, while locking mechanism 264 flexibly extends in a spring-loaded manner from point 271 within slot 263. One-way locking mechanism 264 is spring loaded about point 271 outward toward the opposing inner surface of slot 263 as indicated by 272 (which is opposed to face 273). One-way locking mechanism 264 flexes downward toward face 273 as needed so as to receive strap 202 as indicated in FIG. 10. However, one-way locking mechanism 264 is spring loaded so as to be biased towards face 272 such that locking finger 265 always seeks out a transverse rib 280 within strap 202 so as to be nearest face 272 as possible.

Figure 12:
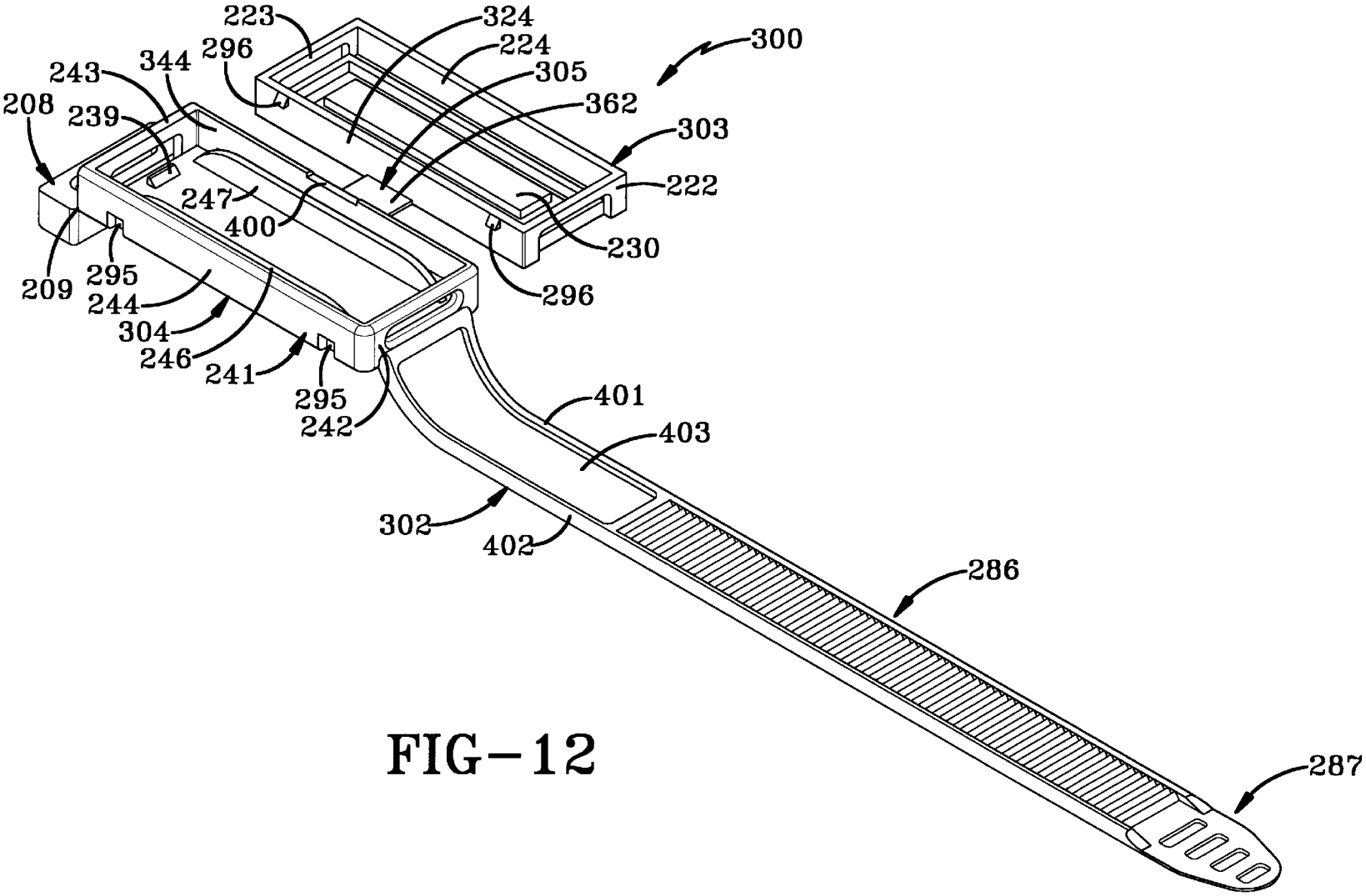
FIG. 12 is a perspective view of a fourth embodiment of the security device of the present invention with the housing in an open position and the strap extending freely therefrom.

A number of locking slots 295 are present in end 244 (FIG. 8). Correspondingly, a number of locking nubs 296 are present on end 224 of lid 203 (these nubs are best shown in FIG. 12 of the fourth embodiment). These slots 295 are positioned to align with locking nubs 296 when lid 203 is closed and seated within base 204.

A fourth embodiment of the improved security device of the present invention is indicated generally at 300 and is shown particularly in FIG. 12. The security device 300 is formed as an integral one-piece plastic member, most preferably of a high-impact and rugged polymer having some flexibility characteristics as previously described above with reference to the other embodiments. This fourth embodiment is substantially similar to the third embodiment as indicated generally at 200, and therefore a majority of the elements and description thereof is incorporated by reference into the fourth embodiment as indicated generally at 300. Therefore, identical numbers are used for substantially similar or identical parts in the improved security device 300.

One of the differences between the third and fourth embodiments is the difference in hinge assembly 205. Particularly, hinge body 262 in the third embodiment extends between lid 203 and base 204 along substantially the entire length of housing 201. In contrast, a hinge assembly 305 as provided with the improved security device 300 is a thin hinge body 362 that connects the lid 303 to the base 304. The hinge body 362 is of the same planar configuration as in the third embodiment except that the hinge body only connects the lid 303 to the base 304 along a limited portion of the length of the housing as best shown in FIG. 12.

In addition, the lid 303 and the base 304 of the improved security device 300 each have two sides identical to those of the security device 200, but also two ends rather than the one end found in security device 200. Specifically, an inner end 344 on base 304 and an inner end 324 on lid 303 are provided. These walls replace the hinge assembly 205 in the security device 200. End 344 is identical in construction to end 244 including having locking slots 295 except that end 344 includes a cutout 400 through which hinge body 362 is wrapped when lid 303 is seated within base 304. Similarly, inner end 324 is identical to end 224 on lid 303 including having locking nubs 296.

Figure 14:
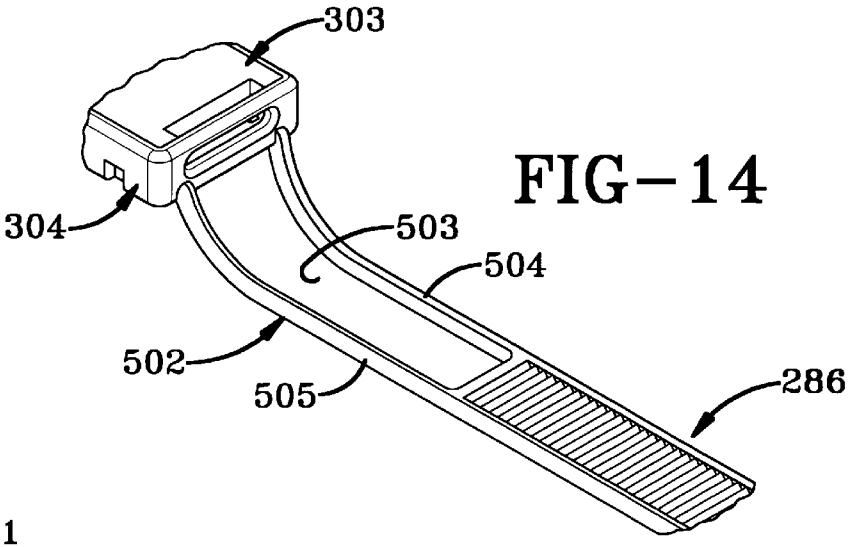
FIG. 14 is a fragmentary perspective view of an alternative fourth embodiment of the security device of the present invention where the base portion of the strap includes a aperture between a pair of elongated members instead of one solid base portion of the strap.
Figure 13:
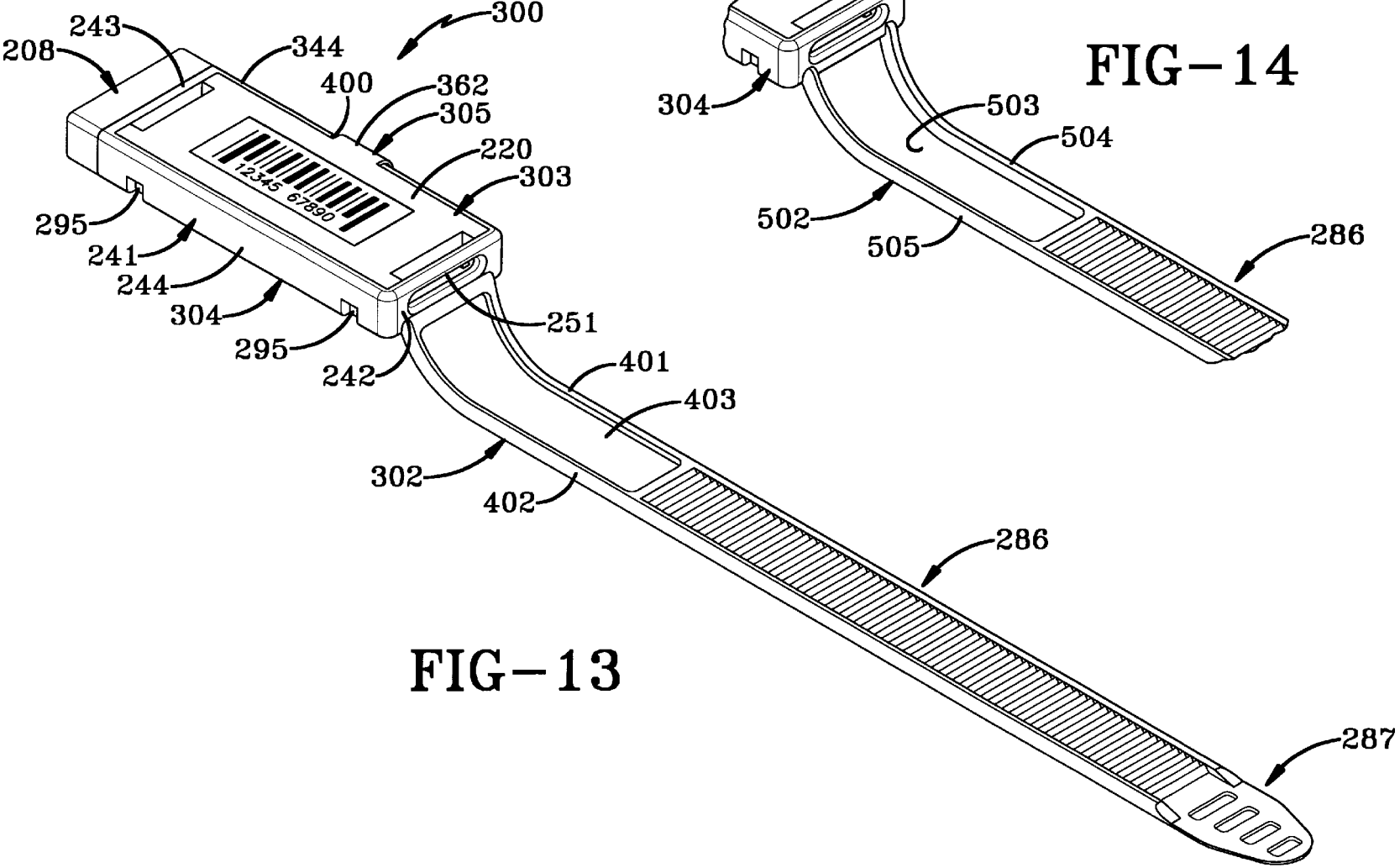
FIG. 13 is a perspective view of a security device of FIG. 12 with the housing in a closed position and the strap still freely extending therefrom.
Figure 15:
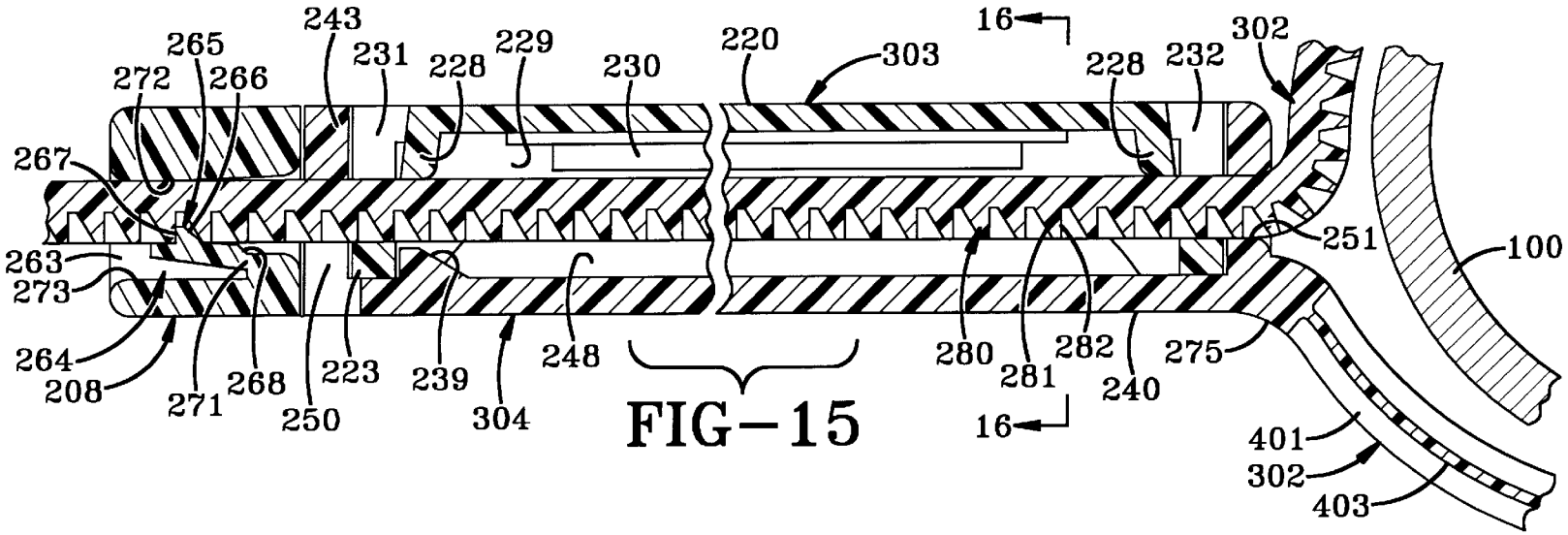
FIG. 15 is an enlarged sectional view of the security device of FIGS. 12–14 with a portion of the strap and article broken away.
Figure 16:
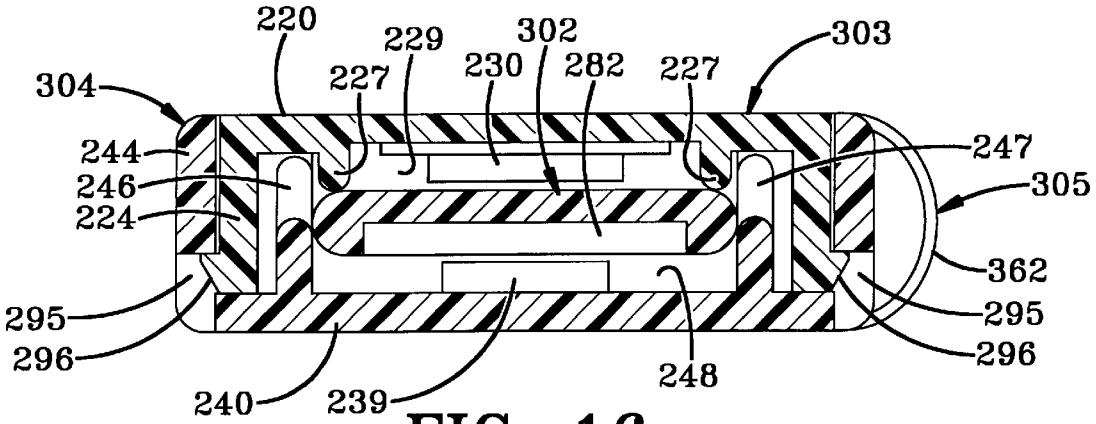
FIG. 16 is an enlarged sectional view of the security device of FIGS. 11–15 taken along lines 16—16 in FIG. 15.

The improved security device 300 may alternatively include any of three differing embodiments of a strap. One potential strap is the elongated strap 202 as shown on the security device 200. A second such strap is shown in FIGS. 12 and 13 as strap 302. Strap 302 is substantially identical to strap 202 except for the construction of the portion of the strap in between the ribbed transverse locking surface area of 280–282 and the straps connection to the housing at connected end 275. Specifically, instead of this portion being a smooth and substantially planar section as is shown in FIG. 8, this portion of strap 302 includes a pair of thick elongated members 401 and 402 separated by a thin web 403 as best shown in FIGS. 12 and 13. The addition of the thin web rather than a thicker overall strap provides additional flexibility in the strap if needed. A third type of strap is strap 502 as shown in FIG. 14. Strap 502 is substantially similar to strap 302 except the thin web 403 is removed thereby providing a gap 503 in between the thick elongated members 504 and 505.

Since the security devices 200 and 300 are substantially similar, each of these devices will be described in operation as follows with reference to the numbers of the third embodiment (security device 200), although such description is equally applicable to both devices except for any minimal changes needed to seat lid 303 within base 304 based upon the hinge changes at hinge assembly 305.

Figure 9:
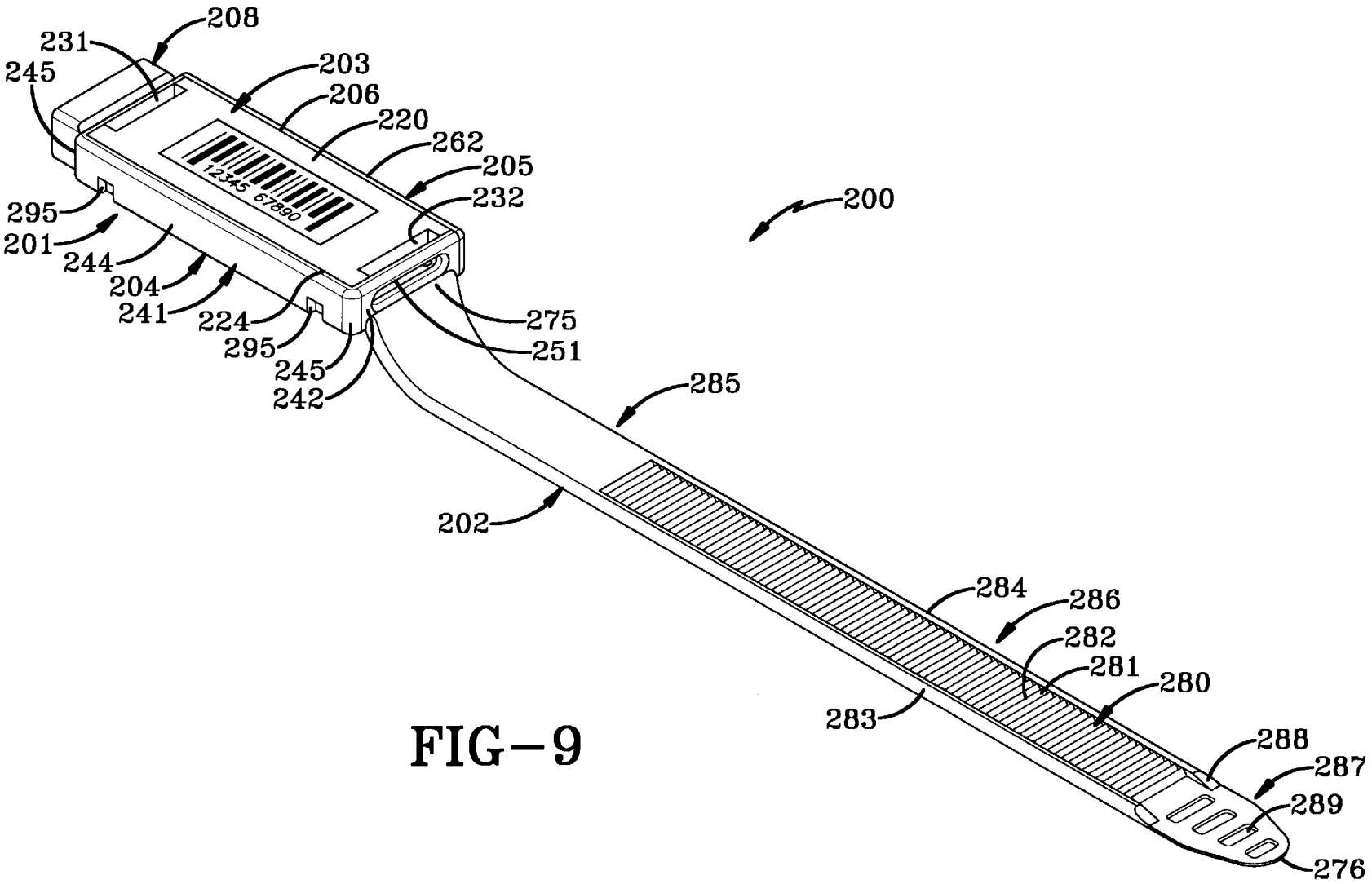
FIG. 9 is a perspective view of the security device of FIG. 8 with the housing in a closed position and the strap still freely extending therefrom.
Figure 11:
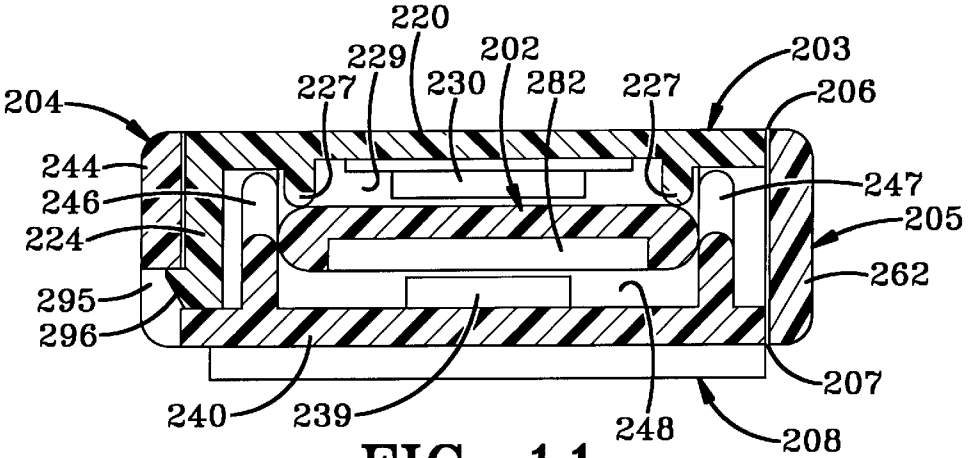
FIG. 11 is an enlarged sectional view of the security device of FIGS. 8–10 taken along line 11—11 in FIG. 10.

In operation, once an EAS tag 230 has been permanently affixed to planar base 220 or alternatively fitted within the area between raised wall 226 in some other desirable manner, the security device 200 is then ready for assembly. Specifically, lid 203 may be closed within base 204 as is shown in FIG. 9. Hinge assembly 205 allows this closing, specifically, living hinges 206 and 207 hingedly bend such that lid 203 moves from a planar position with base 204, as shown in FIG. 8, to a seated position within base 204, as shown in FIGS. 9–11. This seated position is made possible because lid 203 is slightly smaller than base 204 such that wall 221 just fits within wall 241, as shown in FIG. 9. After lid 203 has been seated within base 204, end assembly 208 is then hingedly bent about living hinge 209 in a 90° manner such that slot 263 is aligned with cutouts 250 and 231 in base 204 and lid 203, respectively.

The security device 200 is now ready for securing to an article 100. The article 100 could be any item in any retail store deemed valuable enough to protect via such a security system. One example of such an item is a baseball bat as is fragmentarily shown in FIG. 10. As shown in FIG. 10, the strap 202 of the security device 200 has been wrapped around the article 100 and is inserted within slot or cutout 251 and channel 248, and thereafter out through cutout 231, cutout 250, and slot 263. The strap is allowed to proceed in a one-way manner through slot 263 as is shown in FIG. 10. In effect, locking finger 265 is repeatedly pushed or bend downward about the bias at point 271 such that each locking notch or transverse rib 280 is allowed to pass. However, strap 202 may not be removed as locking finger 265 restricts movement in the reverse direction as is clearly shown by FIG. 10. The strap 202 is thereby tautly wrapped around article 100 such that the strap 202 is pulled tautly through slot 251, channel 248, cutout 231, cutout 250, and through slot 263. The nub 239 further secures the strap 202 within the housing and also prohibits tampering and prying which could damage or open the device.

The security device 200 with an EAS tag 230 therein is now securely attached to article 100. Specifically, this is accomplished by a one-way locking feature as defined by the ribs 280 on the strap 202 and the one-way locking mechanism 264 with locking finger 265 thereon. Specifically, each transverse rib 280 has angled entrance 281 and transverse locking surface 282, and the one-way locking mechanism 264 has locking finger 265 with angled entrance surface 266 and transverse locking surface 267.

During insertion of strap 202 within security device 200, strap 202 smoothly slides within cutout 251, cutout 232, channel 248, cutout 231, cutout 250, and into slot 263. As long as strap 202 continues moving in that same direction, the transverse locking surface 267 of locking finger 265 does not interact with the transverse locking surface 282 of each transverse rib 280. Instead, the angled entrance surface 281 on each rib rides over the angled entrance surface 266 of locking finger 265. However, strap 202 cannot be removed or pulled backwards from slot 263 toward cutout 251 because the finger 264 elastically returns after it rolls over each angled entrance surface so as to block removal of that rib once it has passed due to the transverse nature of the locking surfaces 267 and 282. Eventually, the strap is snugly and tightly held within slot 263. Furthermore, the strap 202 is not removable as described above.

This third embodiment of the invention provides for a unique and easy method of disassembly. Specifically, as is best shown in FIG. 10, end assembly 208 meets with sides 223 and 243 of lid 203 and base 204, respectively. To prevent the formation of any slot in which prying could occur from an attempt to open the device, this interaction point is grooved as is shown in FIG. 10. In effect, this groove defines a cut line along which the device may be cut to be removed from article 100.

Specifically, when scissors cut along this line shown as 299 in FIG. 10, strap 202 is the only body that need be severed. This makes for an easier removal process since the entire device does not need to be cut, which in the past has been a rather difficult to do event due to the properties of the plastic materials. After such cut has occurred, the entire locking mechanism which is positioned within end assembly 208 has been removed, and thereby strap 202 may easily be withdrawn from cutout 250, cutout 231, channel 248, cutout 232, and slot 251, thereby allowing the strap 202 to be unwrapped from around article 100.

The fourth embodiment is very similarly used in operation and therefore is not specifically described in detail.

Figures 17, 18, 19:
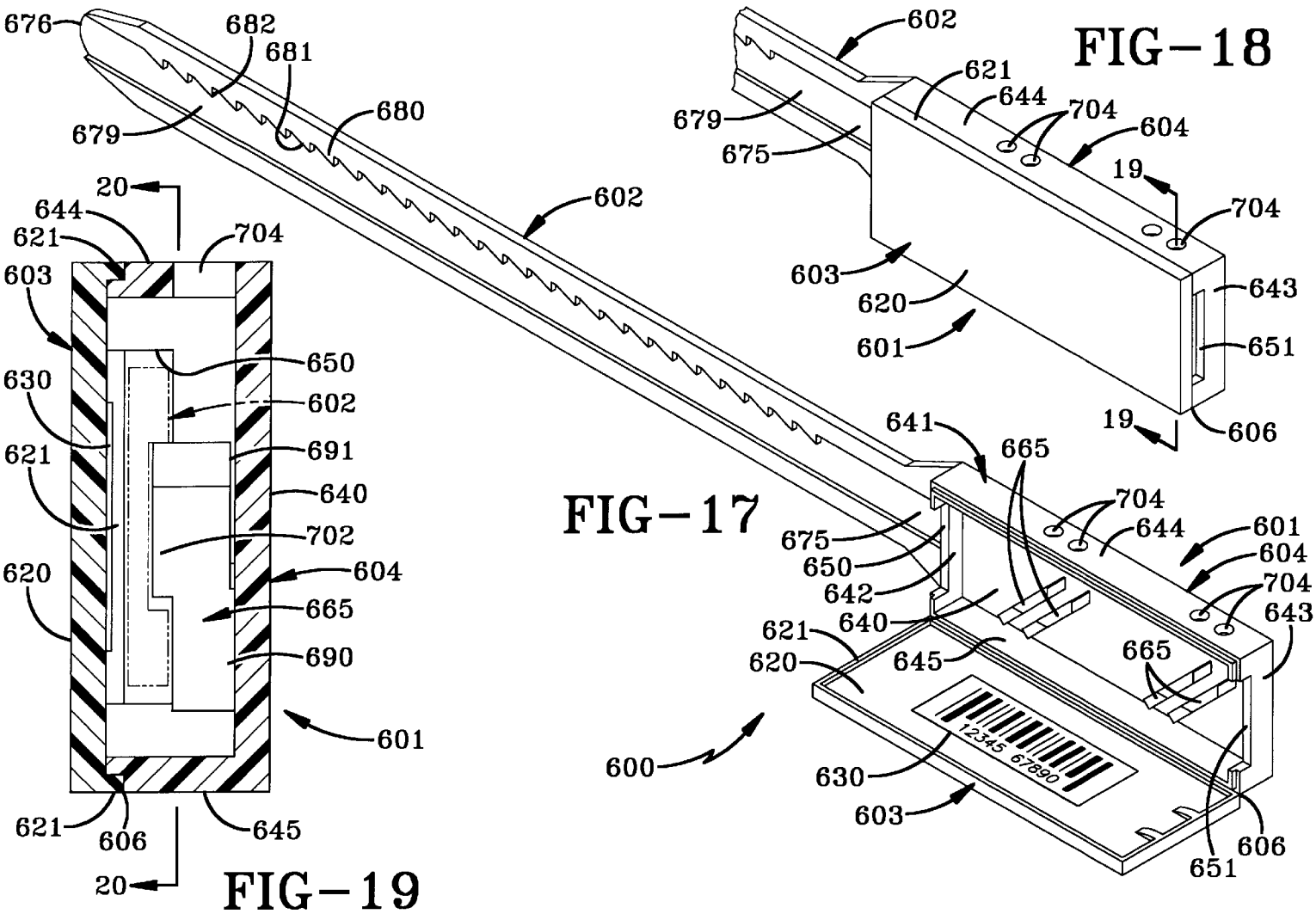
FIG. 17 is a perspective view of a fifth embodiment of the security device of the present invention with the housing in an open position and the strap extending freely therefrom.
FIG. 18 is a fragmentary perspective view of the fifth embodiment of the security device of the present invention with the housing in a closed position and the strap still freely extending therefrom.
FIG. 19 is an enlarged sectional view of the security device of FIGS. 17–18 taken along line 19—19 of FIG. 18 with the strap depicted in phantom in a locked position.

A fifth embodiment of the improved security device of the present invention is indicated generally at 600, and is shown particularly in FIG. 17. Security device 600 is formed as an integral one-piece plastic member, most preferably of a high-impact and rugged polymer having some flexibility characteristics. Security device 600 includes a main housing 601 with an elongated strap 602 extending therefrom. Main housing 601 includes a lid 603, a base 604, a hinge 606, hingably connecting lid 603 with base 604.

Lid 603 includes a planar base 620 of a generally rectangular configuration having inner and outer surfaces. A continuous wall 621 extends substantially perpendicularly outward from the periphery of base 620 along the inner surface. Continuous wall 621 is configured to tightly engage base 604 when main housing 601 is assembled. The electronic article surveillance (EAS) tag 630 is affixed to the inner surface of planar base 620 as shown in FIG. 17. Specifically, continuous wall 621 is sized in a sufficient manner to protect EAS tag 630 from insertion of strap 602 when security device 600 is used.

Base 604 includes a planar base 640 of a generally rectangular configuration having inner and outer surfaces. A continuous wall 641 extends substantially perpendicularly outward from the periphery of planar base 640 along the inner surface. Wall 641 includes a pair of side portions 642, 643 separated by top wall 644 and bottom wall 645.

Side portion 642 includes a substantially rectangular cut out 650 that is substantially aligned with strap 602. Side portion 643 includes a cut out 651 that is also substantially rectangular and sized substantially the same as cut out 650 and is also substantially aligned with elongated strap 602. Each cut out 650, 651 is sized to permit strap 602 to pass therethrough when main housing 601 is closed and strap 602 engages locking fingers 665.

Strap 602 flexibly extends outward from base 604 from a position adjacent to cut out 650 as shown in FIG. 17. Strap 602 has a first or connected end 675 flexibly connected to base 604 and a second or free end 676 spaced apart therefrom. The free end 676 is preferably rounded, curved, or otherwise smooth to provide for easier insertion of strap 602 within cut out 650. Strap 602 includes an inner surface and an outer surface. At least one of the inner or outer surfaces of strap 602 includes a toothed or serrated channel 679. Channel 679 runs substantially from first end 675 to second 676. A plurality of teeth 680 are disposed in channel 679. Each tooth 680 includes an angled entrance surface 681 and a transverse locking surface 682.

A plurality of locking fingers 665 are carried by planar base 640 of base 604. As may be perhaps best seen in FIG. 19, locking fingers 665 are resiliently attached to planar base 640 by a connection portion 690. Locking fingers 665 may be integrally formed with main housing 601 or may be attached by suitable means. Locking fingers 665 are each attached in a manner such that a gap 691 exists between the top of each locking finger 665 and the inner surface of planar base 640. As may also be seen in FIG. 19, each locking finger 665 is substantially aligned with tooth channel 679 such that insertion of strap 602 into main housing 601 causes locking fingers 665 to engage teeth 680. This engagement may also be seen in FIG. 20.

Each locking finger 665 is tilted from its connection portion 690 in the direction of cut out 651. Thus, locking fingers 665 first engage the angled entrance surface 681 of each tooth 680 when strap 602 is inserted into housing 601 through cut out 650. As may be seen in FIG. 19, toothed channel 679 of strap 602 faces and is aligned with locking fingers 665 when strap 602 is inserted into housing 601. Once elongated strap 602 has been inserted in housing 601, locking fingers 665 prevent strap 602 from being pulled back out of housing 601 through cut out 650. The locking fingers 665 are sized and configured in such a manner that they do not easily break upon application of significant force to strap 602. As such, a shoplifter is unable to remove strap 602 from housing 601 without the use of a key 700 such as the one depicted in FIG. 20.

Locking fingers 665 also have a protruding portion 702 that is configured to fit inside toothed channel 679 so that strap 602 cannot be easily moved about when engaged with locking fingers 665. As may be seen in FIG. 19, protruding portion 702 traps the strap 602 between EAS 630 and locking finger 665. Each cut out 650, 651 is also sized to prevent strap 602 from becoming disengaged with locking fingers 665.

Top wall 644 of main housing 601 includes an opening 704 aligned with each locking finger 665. Each opening 704 is configured to slidably receive a tang 706 of key 700. Each tang 706 is long enough to protrude into housing 601 and engage locking fingers 665. Tangs 706 are further long enough to depress locking fingers 665 out of engagement with teeth 680 so that strap 602 may be removed from main housing 601.

Figure 22:
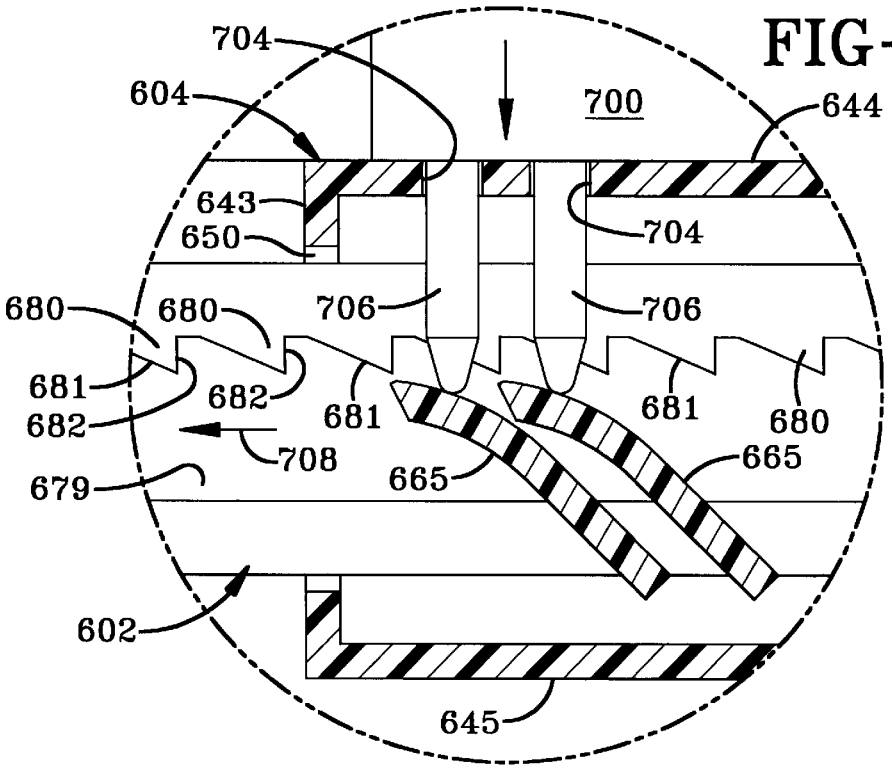
FIG. 22 is an enlarged sectional view of the security device with the key in a second position where the key tangs depress the locking fingers.
Figure 23:
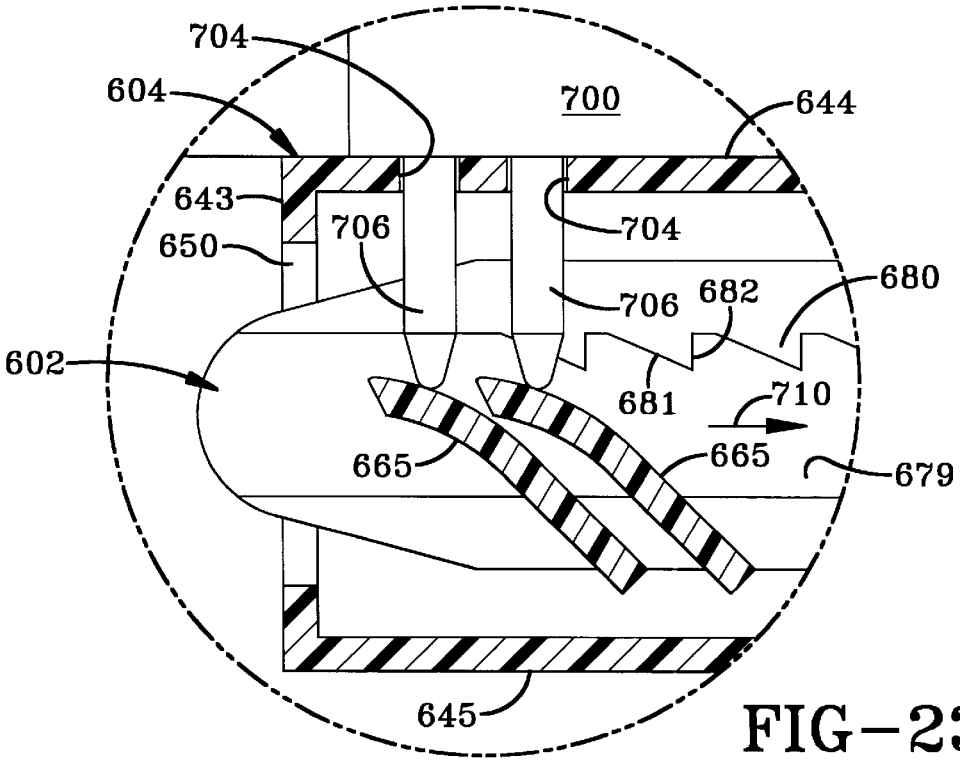
FIG. 23 is an enlarged sectional view of the security device with the key in the second position and the strap being removed from the housing.

To remove strap 602 from main housing 601, key 700 is engaged with housing 601 to a first position shown in FIGS. 20 and 21. In the first position, tang 706 of key 700 are disposed in openings 704 and engaged locking fingers 665. Locking fingers 665, however, remain lockingly engaged with teeth 680 in the first position. Key 700 is next depressed until it engages top wall 644 of main housing 601 as depicted in FIG. 22. In this second position, tangs 706 have depressed locking fingers 665 away from teeth 680 such that each locking finger 665 has disengaged strap 602. While this occurs, strap 602 is forced further into housing 601 in the direction indicated by arrow 708 through the engagement of locking fingers 665 and transverse locking surface 682. Once locking fingers 665 have been depressed by tangs 706, strap 602 may be removed from housing 601 in the direction of arrow 710. After strap 602 has been removed from housing 601, key 700 is removed allowing locking fingers 665 to resiliently return to their original position. In this way security device 600 may be reused multiple times.

Accordingly, the improved security package is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved security device is constructed and used, the characteristics of the construction, and the advantageous, new and useful results obtained; the new and useful structures, devices, elements, arrangements, parts and combinations, are set forth in the appended claims.

We claim:

1. A security package affixable around or interwoven through an article to be protected from theft in combination with a key; the combination comprising:

a housing having a lock compartment, said lock compartment having an entry port and an exit port;

a locking mechanism carried by said housing between said entry port and said exit port of said lock compartment;

a strap having a proximate end, a distal end, and an intermediate section therebetween having a toothed surface for selective interaction with said locking mechanism, said proximate end being affixed to said housing and said distal end being selectively insertable within said lock compartment;

said locking mechanism including at least two locking fingers extending into said housing where said fingers allow insertion of said strap therein while prohibiting removal once insertion has occurred; each locking finger being disposed entirely within said housing;

said housing including an opening aligned with each of said locking fingers;

said key having a tang for each locking finger; said tangs disposed so that they may be simultaneously slidably received in said openings; and each of said locking fingers being selectively movable from a locked position to an unlocked position, said strap being removable from said housing only when each of said fingers are in said unlocked position.

2. The security device of claim 1 wherein each of said tangs has a length, said length of said tangs being sufficient to allow said tangs to engage said locking fingers and further to depress each of said locking fingers from a first locked position to a second unlocked position when said tangs are inserted into said openings.

3. The security device of claim 1, wherein said strap includes a longitudinal channel, said toothed surface extending into said longitudinal channel.

4. The security device of claim 3 wherein each of said locking fingers extends into said longitudinal channel of said strap when said strap is inserted into said housing.

5. The security device of claim 4, wherein each locking finger includes a protruding portion that extends into said longitudinal channel of said strap.

6. The security device of claim 1, further comprising an EAS tag disposed in said housing.

7. The security device of claim 1, wherein each locking finger is tilted toward the exit port.

8. The security device of claim 1, wherein the locking mechanism includes four spaced locking fingers that extend into said housing.

9. A security package affixable around or interwoven through an article to be protected from theft; the security package comprising:

a housing having a lock compartment, said lock compartment having an entry port and an exit port;

a locking mechanism carried by said housing between said entry port and said exit port of said lock compartment;

a strap having a proximate end, a distal end, and an intermediate section therebetween having a toothed surface for selective interaction with said locking mechanism, said proximate end being affixed to said housing and said distal end being selectively insertable within said lock compartment;

said locking mechanism including at least two independently movable locking fingers extending into said housing where said fingers allow insertion of said strap into said housing while prohibiting removal of said strap from said housing once insertion has occurred; each locking finger being disposed entirely within said housing; said locking mechanism lacking any element connected to a locking finger that extends outside said housing;

said housing including an individual opening aligned with each of said locking fingers; and each of said locking fingers being selectively movable from a locked position to an unlocked position, said strap being removable from said housing only when each of said fingers is in said unlocked position.

10. The security package of claim 9, wherein the locking mechanism includes four independently movable locking fingers; each of said locking fingers being spaced from the other of said locking fingers.

11. The security package of claim 10, wherein the strap includes a longitudinal channel; each of said fingers having a protruding portion that slidingly engages the strap in said channel.

12. The security package of claim 11, further comprising an EAS tag disposed in said housing.

13. A security package affixable around or interwoven through an article to be protected from theft; the security package comprising:

a housing having a lock compartment, said lock compartment having an entry port and an exit port;

an EAS tag disposed within said housing;

a locking mechanism carried by said housing between said entry port and said exit port of said lock compartment;

a strap having a proximate end, a distal end, and an intermediate section therebetween having a toothed surface for selective interaction with said locking mechanism, said proximate end being affixed to said housing and said distal end being selectively insertable within said lock compartment;

said strap having a longitudinal channel bounded by a pair of walls; one of the walls having said toothed surface formed therein; said toothed surface including a plurality of teeth; each of said teeth extending only partially across said longitudinal channel;

said locking mechanism including a locking finger extending into said housing where said finger allows insertion of said strap into said housing while prohibiting removal of said strap from said housing once insertion has occurred; said finger being disposed entirely within said housing; said locking mechanism lacking any element that allows manipulation of said locking finger;

said locking finger being slidably received in said longitudinal channel of said strap;

said housing including an opening aligned with said locking finger; and said locking finger being selectively movable from a locked position to an unlocked position, said strap being removable from said housing only when said finger is in said unlocked position.

* * * * *